United States Patent [19]

Harwood et al.

[11] Patent Number: 4,847,965

[45] Date of Patent: Jul. 18, 1989

[54] METHOD OF MANUFACTURING STAMP FORMED MUFFLERS

[75] Inventors: Jon W. Harwood, Toledo, Ohio; Wayne A. Karlgaard, Dyersburg, Tenn.

[73] Assignee: AP Parts Manufacturing Company, Toledo, Ohio

[21] Appl. No.: 259,176

[22] Filed: Oct. 18, 1988

[51] Int. Cl.[4] ..... B21D 53/00

[52] U.S. Cl. ..... 29/157 R; 29/463; 29/157.4

[58] Field of Search ..... 29/157 R, 157.4 R, 463, 29/469.5; 72/413, 473, 478; 181/250, 266, 268, 272, 273, 282

[56] References Cited

U.S. PATENT DOCUMENTS

| | | | |
|---|---|---|---|
| 3,176,791 | 4/1965 | Betts et al. . | |
| 3,479,725 | 11/1969 | Shaff et al. | 29/157 R |
| 3,638,756 | 2/1972 | Thiele | 181/282 |
| 3,638,756 | 2/1972 | Thicle . | |
| 4,132,286 | 1/1979 | Hasui et al. . | |
| 4,396,090 | 8/1983 | Wolfhugel . | |
| 4,415,059 | 11/1983 | Hayashi . | |
| 4,700,806 | 10/1987 | Harwood | 181/272 |
| 4,736,817 | 4/1988 | Harwood | 181/272 |
| 4,759,423 | 7/1988 | Harwood et al. | 181/272 |
| 4,760,894 | 8/1988 | Harwood et al. | 181/272 |
| 4,765,437 | 8/1988 | Harwood et al. | 181/272 |
| 4,777,708 | 10/1988 | Harwood et al. | 29/157 R |

FOREIGN PATENT DOCUMENTS

| | | |
|---|---|---|
| 59-43456 | 9/1984 | Japan . |
| 632013 | 1/1950 | United Kingdom . |
| 1012463 | 12/1965 | United Kingdom . |

*Primary Examiner*—Howard N. Goldberg
*Assistant Examiner*—Irene Cuda
*Attorney, Agent, or Firm*—Anthony J. Casella; Gerald E. Hespos

[57] ABSTRACT

Stamped formed mufflers and a process for forming stamped formed mufflers is provided. The mufflers are stamp formed from master dies having a plurality of die subsets removably mounted therein. At least one subset may include several die inserts removably mounted therein. The subset and insert dies are selected to effect the acoustical performance of the resulting muffler. Thus, a system of mufflers may be formed having generally the same pattern of tubes therein. However, selected mufflers in the system will have portions thereof which are different from other mufflers in the system, depending upon the particular die subsets selected for mounting in the master die, and the particular die inserts selected for mounting in the subsets.

8 Claims, 3 Drawing Sheets

METHOD OF MANUFACTURING STAMP FORMED MUFFLERS

BACKGROUND OF THE INVENTION

The typical prior art exhaust muffler comprises separate tubes supported in a parallel array by a plurality of transversely extending baffles. Selected tubes in the array are provided with perforations, louvers, apertures or the like to permit a controlled expansion of exhaust gases travelling through the tubes. The assembly of tubes and baffles are slid within a generally tubular outer shell having an oval or circular cross section corresponding to the shape of the baffles. An outer wrapper may be wrapped around and secured to the tubular outer shell of the muffler to dampen vibrations of the tubular outer shell and prevent vibration related noise. End caps are securely affixed to opposed ends of the tubular outer shell and outer wrapper to substantially enclose the muffler. Each end cap typically will be provided with one or more apertures to define at least one inlet and at least one outlet for the muffler. This prior art construction provides a plurality of chambers within the muffler. In particular, the chambers are defined between the tubular outer shell and either two adjacent baffles or between one baffle and an end cap.

The dimensions and relative spacing of the various components within the above described prior art muffler are selected in accordance with engine specifications and operating performance. For example, the diameters of the respective tubes in the muffler may be selected in accordance with the flow rates of exhaust gases at different engine operating conditions, and in accordance with a specified allowable back pressure that may be created by the muffler.

Certain chambers within these prior art mufflers will define expansion chambers having perforated of louvered tubes extending therethrough. The volume encompassed by the expansion chamber and the total area encompassed by the perforations or louvers in the tubes will be selected in accordance with the noise characteristics exhibited by the flow of exhaust gas from the engine. Generally the expansion chambers will be constructed to attenuate a very broad range of the noise. However, one or more fairly narrow bands of low frequency noise typically will remain despite the broad attenuation achieved by the expansion chamber. Thus, the typical prior art muffler will comprise at least one low frequency resonating chamber into which a tuning tube extends. The volume of the low frequency resonating chamber and the length and cross sectional area of the tuning tube will be selected in accordance with the particular low frequency sound to be attenuated. Many mufflers will require two physically and functionally separate low frequency resonating chambers and tuning tube combinations to attenuate two distinct ranges of low frequency sounds.

The dimensions and spacial disposition of the components in the prior art muffler may be determined by an acoustical analysis of the exhaust related engine noise. In particular, the analysis of the exhaust related noise would be considered in view of the exhaust gas flow rates and the specified allowable back pressure to design a muffler that would meet specified noise levels. However, most automobile manufacturers produce families of similar vehicles, with each member of the family having either a slightly different version of a common engine, or a different array of engine accessories. Thus, vehicles within such a family would have different exhaust characteristics and/or different performance requirements, and thus, exhaust related noise patterns could vary from one vehicle in a family to another. In most such families of related vehicles, the external envelope required by the various mufflers typically would be constant. However, the internal components of the muffler could vary significantly depending upon the above-described parameters.

The typical prior art muffler with separate tubes, baffles and a tubular outer shell can be redesigned readily to accommodate specific engine or operating characteristics. For example, the manufacturer of the above described prior art muffler would merely have to select tubes having lengths and cross sectional dimensions necessary to meet the specified performance of the particular engine. Similarly, the area encompassed by perforations, louvers or the like in selected tubes of the prior art muffler could readily be achieved using manufacturing equipment and stock materials that are available to the manufacturer of the prior art muffler. Furthermore, the volume encompassed by different chambers within the above described prior art muffler can readily be altered by merely changing the longitudinal position of one or more baffles relative to the tubes of the muffler. Thus variations from one such prior art muffler to the next within a particular family of mufflers could readily be achieved with available stock materials and manufacturing equipment.

The above described prior art muffler has provided adequate acoustical performance and provides for simple variations to muffler configurations that match the performance needs of similar but different engines. However, the above described prior art muffler has several substantial disadvantages. In particular, this typical prior art muffler inherently requires a labor intensive manufacturing process. The large number of separate components also tends to yield a relatively heavy muffler with a corresponding performance penalty for the entire vehicle. Prior art mufflers of this type also are limited to a generally rectangular plan view configuration with essentially fixed locations for the inlet and outlet pipes. These limitations often make it difficult to fit the muffler, the exhaust pipe and the tail pipe into the very limited available space on the underside of the vehicle.

The prior art further includes mufflers manufactured at least in part from stamp formed components. For example, U.S. Pat. No. 4,396,090, which issued to Wolfhugel on Aug. 2, 1983 shows a muffler having a pair of internal plates stamp formed to define pairs of opposed channels. The internal plates are assembled to one another such that each pair of opposed channels defines a tube therebetween. The internal plate defining the channels is disposed within a conventional wrapped outer shell, as in the above described typical muffler.

The prior art also include mufflers consisting only of two opposed shells which are stamped to define a convoluted array of tubes and chambers through which the exhaust gas may travel. Mufflers of this type are shown in U.S. Pat. No. 3,176,791 which issued to Betts et al. on Apr. 6, 1965 and in U.S. Pat. No. 3,638,756 which issued to Thiele on Feb. 1, 1972.

Prior art mufflers having more than two stamp formed components also are known. These prior art mufflers have comprised a pair of internal plates stamped to define opposed channels, with the aligned channels defining tubes therebetween. Selected portions of the tubes have been formed with perforations to permit the expansion of exhaust gases from the tubes. A pair of stamped external shells have been disposed about the internal plates to define a chamber surrounding the perforated formed tubes. The chambers have effectively functioned as expansion chambers to attenuate a broad range of exhaust related noise. Examples of these types of mufflers are shown in British Pat. No. 632,013 which issued to White in 1949; British Pat. No. 1,012,463 which issued to Woolgar on Dec. 8, 1965; Japanese Published Patent Application No. 59-43456 which was published in 1984; U.S. Pat. No. 4,132,286, which issued to Hasui et al. on Jan. 2, 1979; and, U.S. Pat. No. 4,415,059, which issued to Hayashi on Nov. 15, 1983.

Stamp formed mufflers offer the potential of overcoming many of the deficiencies of the above described conventional mufflers with separate tubes and baffles supported in a tubular outer shell and wrapper. In particular, stamp formed mufflers can be formed from many fewer components in manufacturing processes that are well suited to automation. Furthermore, stamp formed mufflers can result in substantially lighter exhaust systems, with corresponding benefits to the vehicular performance.

The above described prior art stamp formed mufflers have not received significant commercial success in the United States. The lack of substantial commercial success has partly been attributable to the poor acoustical performance of these prior art stamp formed mufflers as compared to the acoustical performance of conventional mufflers. In particular, the above described prior art stamp formed mufflers have generally relied upon a single expansion chamber to attenuate most noise. The low frequency noise that may not be adequately attenuated by an expansion chamber has generally remained with the above described prior art stamp formed mufflers. These prior art stamp formed mufflers have received some commercial success in Europe where somewhat higher noise levels have been tolerated. In view of the comparative lack of acoustical tuning, these prior art stamp formed mufflers have not attempted to match the internal construction of each muffler to the particular engine configuration on the vehicle. Thus, a single expansion chamber might be employed for a fairly broad range of engine types.

Recently several significant improvements have been made to stamp formed mufflers. In particular, U.S. Pat. No. 4,700,806 which issued to Jon Harwood on Oct. 20, 1987 shows a muffler formed from stamp formed components and providing the combination of at least one tuning tube and at least one low frequency resonating chamber. Mufflers manufactured in accordance with U.S. Pat. No. 4,700,806 are extremely successful in attenuating both high frequency and low frequency noise and provide acoustical performances equal to or better than conventional mufflers formed from separate tubes, baffles and a tubular outer shell. In view of this superior performance and the other advantages of stamp forming, the mufflers manufactured in accordance with U.S. Pat. No. 4,700,806 have achieved very substantial commercial success in a short period of time. Other improvements relating to stamped mufflers are shown in U.S. Pat. No. 4,736,817 which issued to Jon Harwood on Apr. 12, 1988; U.S. Pat. No. 4,759,423 which issued to Jon Harwood et al. on July 26, 1988; U.S. Pat. No. 4,760,894 which issued to Jon Harwood et al. on Aug. 2, 1988; and, U.S. Pat. No. 4,765,437 which issued to Jon Harwood et al. on Aug. 23, 1988. All of the above described Harwood patents are assigned to the assignee of the subject invention, and the disclosures thereof are incorporated herein by reference.

Although the improvements described in the above identified Harwood patents provide for exceptional acoustical performance, it is desirable to match the acoustical performance of the muffler with each particular engine. For example, each variation of a family of similar engines may require slightly different acoustical tuning. As explained above, optimum acoustical performance is obtained with conventional mufflers by altering the length or cross sectional area of certain tubes, by increasing the total area encompassed by perforations, louvers or apertures, or by moving baffles longitudinally relative to the tubes. Changes of this type can readily be accomplished within the labor intensive manufacturing process of conventional mufflers. Stamp formed mufflers, on the other hand, are formed with carefully manufactured stamping dies having a specified shape. Thus, despite the above referenced manufacturing efficiencies available with stamp formed mufflers, the prior art stamp formed muffler technology is not well suited to minor changes to enable the muffler to match the performance characteristics of various engines. This had not been a particular problem on the earlier versions of European stamped mufflers, because these prior art mufflers did not approach the noise attenuation available with conventional mufflers. The exhaust related noises that would result from altering the characteristics of an engine were well within the broad range of noise levels accepted with vehicles having these prior art stamped mufflers.

Stamp formed mufflers can only be incorporated into the mainstream of original equipment American mufflers by achieving the acoustical performance of conventional mufflers. The need to make separate stamping dies for each engine variation, however, would impose a substantial cost penalty on the stamped muffler.

In view of the above, it is an object of the subject invention to provide stamp formed mufflers that can readily accommodate the acoustical requirements of a plurality of different engines.

It is another object of the subject invention to provide stamp formed mufflers that can achieve different back pressure levels in accordance with the specifications for each of a plurality of different engines.

It is an additional object of the subject invention to provide stamp formed mufflers that can achieve different ranges of low frequency tuning in accordance with each of several different engine requirements.

A further object of the subject invention is to provide stamp formed mufflers that can reduce the number of stamping dies required for manufacturing a plurality of different mufflers.

Still another object of the subject invention is to provide a method for manufacturing a plurality of different stamp formed mufflers

SUMMARY OF THE INVENTION

The subject invention is directed to mufflers which are progressively stamp formed with a plurality of opposed pairs of master dies, with selected master dies having a plurality of interchangeable die subsets for each respective progressive stamping station. Selected die subsets may further comprise interchangeable die inserts. Interchangeable subsets and inserts are strategically located on the master dies to define portions of the muffler that will affect the acoustical performance. The particular combination of interchangeable subsets and inserts is selected in accordance with the required acoustical performance of the muffler.

At least one die subset or die insert may be disposed to selectively define a minimum stamp formed cross sectional area for a tube. The minimum cross sectional area will at least in part define the back pressure caused by the muffler and may alter the flow path of exhaust gases travelling through the muffler. At least one subset or insert may additionally or alternatively be disposed on the master die to define the cross sectional area achieved by perforations, louvers or apertures in selected portions of the muffler. At least one additional or alternative subset or insert may be disposed on the master die to define the length or cross sectional area of a tuning tube employed in the muffler. In certain situations inserts may further be employed to alter the volume achieved by a chamber.

All of the mufflers formed by the master die, with the die subsets and interchangeable die inserts described above may define generally the same external size and shape. Additionally, a plurality of mufflers manufactured by the above defined dies may have the same general pattern of tubes extending therethrough. In particular, all or a plurality of the mufflers may define inlets and outlets in generally the same locations. All or a plurality of the mufflers may further include the same number of tubes in generally the same location with patterns of perforations, apertures or the like being disposed in generally the same locations. However, by selective use of the interchangeable die subsets in the master dies and die inserts in the subsets, the array of tubes may define a neck of variable dimensions, differently dimensioned arrays of apertures or perforations and/or tuning tubes of different dimensions.

The above described system of similar but different mufflers can be stamp formed without relying upon a plurality of entirely separate sets of master dies. Rather, the same master dies can be employed for all of the different mufflers in the system by merely substituting the relatively inexpensive interchangeable die subsets at selected locations on the master die and substituting die inserts in selected subsets to alter the performance of the muffler as explained above.

The subject invention is further directed to a method of forming a plurality of mufflers. The method comprises the step of providing pairs of master stamping dies. The method further comprises the step of providing a plurality of die subsets for selective positioning within the master dies, and a plurality of die inserts for selective positioning in one or more subsets. As a further step, at least one of the die subsets is selected for placement in at least one of the master dies, while at least one insert may be selected for placement in a die subset. The method further comprises the step of sequentially stamping an elongated sheet of metal or a plurality of sheets of material, such that at least one sheet of material is formed from each pair of master dies having a first array of die subsets and/or die inserts therein, and such that at least one other sheet of material is formed from a pair of master dies having a second array of die subsets and/or die inserts therein. A plurality of mateable sheets of material formed with the first arrays of die subsets and/or die inserts therein are then securely connected to one another to define a muffler. A second plurality of sheets of material formed with the second array of die subsets and/or die inserts in the master dies are then connected to define at least one second muffler. The first and second mufflers may define generally the same external configuration and generally the same pattern of formed tubes. However, selected portions of the formed tubes will be structurally and functionally distinct from one another in accordance with the particular arrays of die subsets and die inserts employed. These differences between the mufflers will be selected in accordance with the required performance of the respective mufflers.

DETAILED DESCRIPTION OF THE PREFERRED EMBODIMENT

Figure 1:
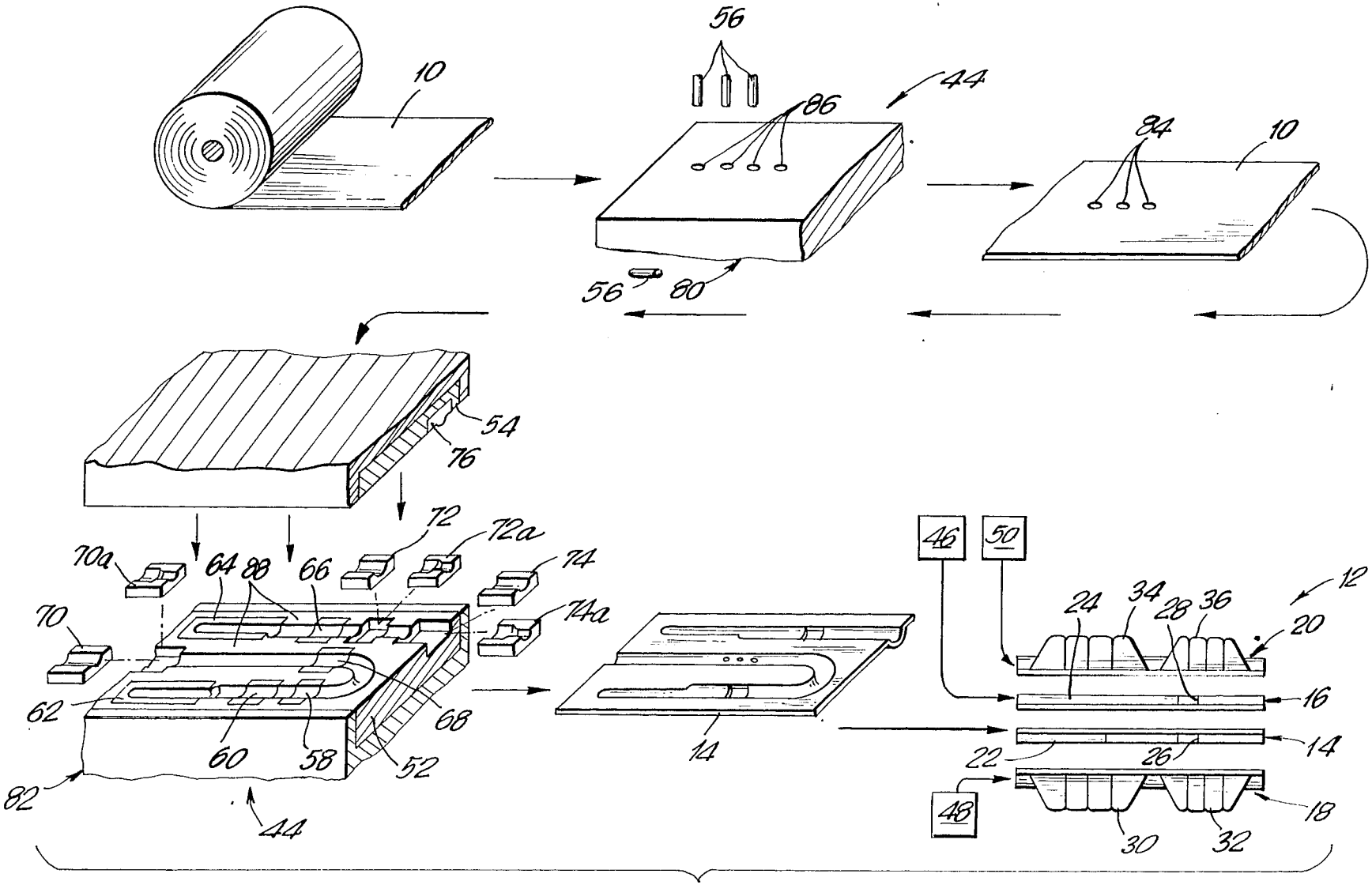
FIG. 1 is a flow diagram schematically illustrating the process of invention.
Figure 2:
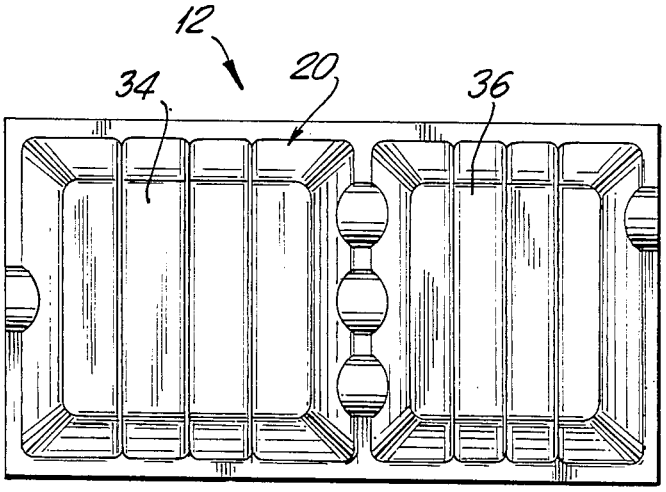
FIG. 2 is a top plan view of a muffler manufactured in accordance the process of the subject invention.
Figure 3:
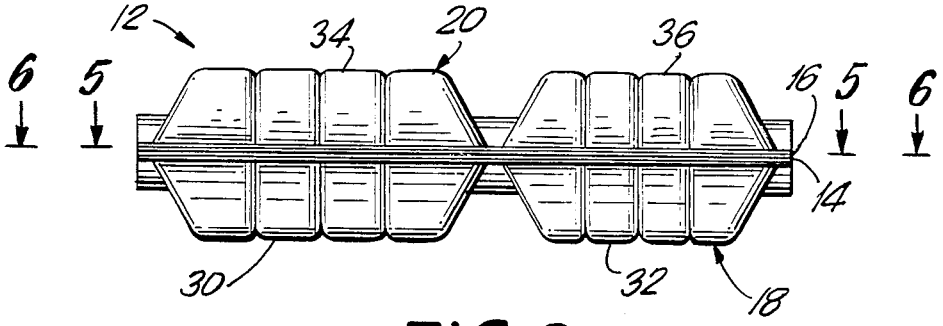
FIG. 3 is a side elevational view of the muffler shown in FIG. 5.

The subject invention is directed to a process for manufacturing stamp formed exhaust mufflers, and to the mufflers produced by the process. The process of the subject invention is illustrated schematically in FIG. 1. In particular, the process employs a coil of sheet metal 10 which is formed in progressive stamping operations to define components of an exhaust muffler 12, which is shown in FIGS. 1–3. The muffler 12 comprises four components, namely a pair of internal plates 14 and 16, and a pair of external shells 18 and 20. As will be explained and illustrated further below, the internal plates 14 and 16 are progressively stamped to define arrays of channels 22 and 24 respectively. The arrays of channels 22 and 24 are formed at locations on the internal plates 14 and 16, to define arrays of tubes upon attachment of the internal plates 14 and 16 in face to face relationship. Selected portions of the tubes defined by the channels formed in the internal plates 14 and 16 are provided with cutouts 26 and 28 and/or with perforations, louvers, apertures or the like to permit a controlled flow of the exhaust gases from the tubes. The external shells 18 and 20 are stamp formed to define chambers 30–36. The chambers 30–36 are dimensioned and disposed to provide communication with portions of the tubes 22 and 24 with cutouts 26 and 28 or perforations, louvers, apertures or the like therein.

The muffler 12 illustrated herein includes clearly asymmetrical internal plates 14 and 16 and external shells 18 and 20. As a result, each component 14–20 will be progressively stamp formed in separate master dies 44–50 respectively. Details of the master die 44 are schematically shown in FIG. 1. The master dies 46–50 are shown only in block form, but would incorporate similar principles as explained below.

As noted above, automobile manufacturers frequently will employ several variations of an engine in attempting to tailor the vehicular performance to different groups of consumers. These changes in the engine performance affect the exhaust related noise patterns produced by the vehicle. Prior art conventional mufflers are structurally varied to match the particular engine performance by simply altering the dimensions of the stock tubes employed in the muffler, relocating baffles relative to the tubes, and other such relatively simple revisions employing available stock materials.

The prior art included no comparable means for altering a stamp formed muffler in accordance with each revision to an engine. As a result, prior art stamp formed mufflers were often less effective than conventional mufflers in attenuating exhaust noise. Furthermore, providing dedicated master dies for each muffler variation would impose a cost penalty on any attempt to closely match the acoustical performance of the muffler with the engine performance.

The method illustrated in FIG. 1 overcomes these problems with the prior art stamp formed mufflers. The method illustrated in FIG. 1 progressively stamp forms each component, e.g., internal plate 14, with a master die 44 having a plurality of die subsets 52, 54 and replaceable die inserts 56–76 to alter the acoustical performance of a muffler 12. In particular, FIG. 1 schematically illustrates the process for forming the internal plates 14 of the muffler 12 from an elongated sheet of metal 10 unrolled from a coil. It is to be understood that substantially identical processes may be carried out for forming the opposed internal plate 16, and that similar processes would be carried out for forming the external shells 18 and 20.

The process schematically illustrated in FIG. 1 includes a first step of sequentially advancing the sheet of metal 10 to and through the master die 44. The master die 44 is likely to have several stamping stations for progressively stamping the sheet 10, with the number of stations depending upon the complexity of the stamping. For simplicity of this explanation, the master die 44 is depicted as having a first stamping station 80, with the remaining stamping stations being schematically shown at location 82 on master die 44. The first stamping station 80 is operative to stamp form an array of perforations 84 into the sheet 10. The perforations 84 are formed at a location on the sheet 10 that will correspond to a channel on the internal plate 14 formed from the sheet 10. As noted above, the total cross sectional area of the perforations 84 is one parameter that can significantly affect the performance of the muffler 12. As a result, the stamping station 80 is provided with an array of apertures 86 and a corresponding array of selectively removable insert dies 56. The array of apertures 86 in the stamping station 80 corresponds to the maximum cross sectional area of perforations 84 required for any muffler within a system of similar or interrelated mufflers. The number of inserts 56 employed at the stamping station 80 is selected in accordance with the total perforation area required for a particular muffler to match the acoustical performance required for a selected vehicular engine. The number of inserts 56 employed in a particular stamping operation at the stamping station 80 will be equal to or less than the number of apertures 86. To illustrate this point, the staming station 80, schematically depicted in FIG. 1, comprises a total of four apertures 86 but only three inserts 56 aligned therewith. This schematically illustrated example represents a muffler requiring a total perforation area equal to the sum of the cross sectional areas of the three inserts 56. The fourth insert 56 is schematically illustrated as being disposed at an off line location for possible incorporation into the stamping station 80 in accordance with the noise attenuation needs of a different muffler in the system of mufflers. It is to be understood, however, that in the typical muffler manufacturing process, many more than four perforations 84 would be provided for a particular array of perforations. It is also to be understood that in other embodiments, non-circular perforations, louvers or large apertures or any combination thereof may be provided by correspondingly configured inserts.

The process schematically illustrated in FIG. 1 further comprises the step of stamp forming an array of channels 22 and cutouts 26 in the sheet of metal 10 to define an internal plate 14 for a muffler 12. The formation of the array of channels 20 in the internal plate 14 is schematically illustrated as being carried out at a stamping station 82. As noted above, the illustration of a single stamping station 82 is provided for the simplicity of this schematic illustration and the corresponding explanation. It is to be understood, however, that in actual practice the stamping station 82 may comprise a plurality of progressive stamping stations for progressively forming the sheet of metal 10 into the internal plates 14.

The stamping station 82 schematically illustrated in FIG. 1 includes a replaceable female die subset 52 and a corresponding replaceable male die subset 54. In actual practice, each progressive stamping station along the length of the master die 44 would include an opposed pair of replaceable die subsets for carrying out a selected portion of the progressive stamping. The die subsets 52 and 54 at the schematically illustrated stamping station 82 include a plurality of substantially permanent die portions for defining channels, such as portions 88 of the die subset 52. However, the die subsets 52 and 54 include an array of selectively replaceable die inserts, such as the die inserts 58–74 which are removably positionable in the female die subset 52. A corresponding array of removable die inserts, such as the insert 76 are similarly selectively and replaceably mounted in the male die subset 54. The particular array of inserts 60–76 are selected to achieve a particular dimensional pattern of channels 22 in the internal plate 14. Thus, as shown schematically at stamping station 82, one or more of the alternate die inserts 70*a*, 72*a*, or 74*a* may be inserted in the female die subset 52 in place of the die insert 70, 72 or 74. A corresponding array of die inserts would then be selected for the male die subset 54. The resulting internal plate 14 having a particular array of channels 22 formed therein is illustrated as having been removed from the end of the master die 44. The internal plate 14 is assembled with the internal plate 16 and the external shells 18 and 20 which are produced respectively from the progressive master stamping dies 46–50 respectively. The assembly of the internal plates 14 and 16 and the external shells 18 and 20 produces the muffler 12 shown in FIGS. 2 and 3.

Figure 4:
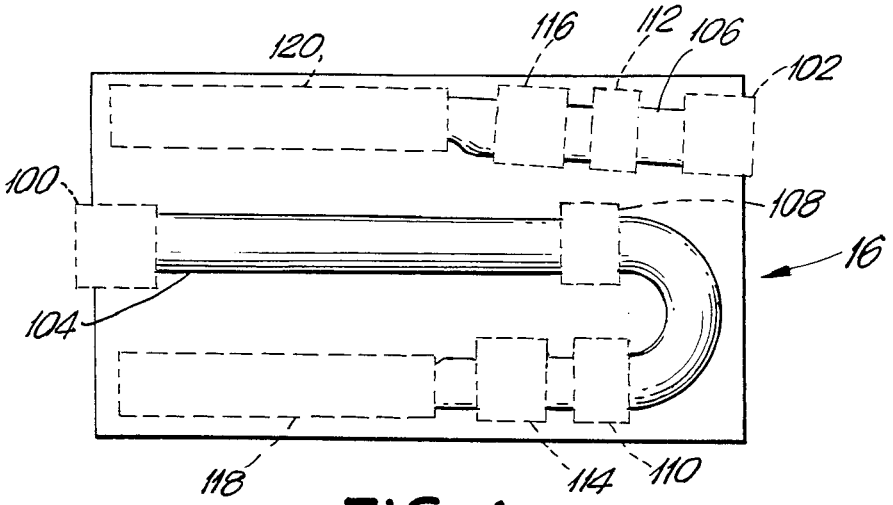
FIG. 4 is a schematic illustration of an internal plate for a muffler identifying locations to be stamp formed inserts in a stamping apparatus.
Figure 5:
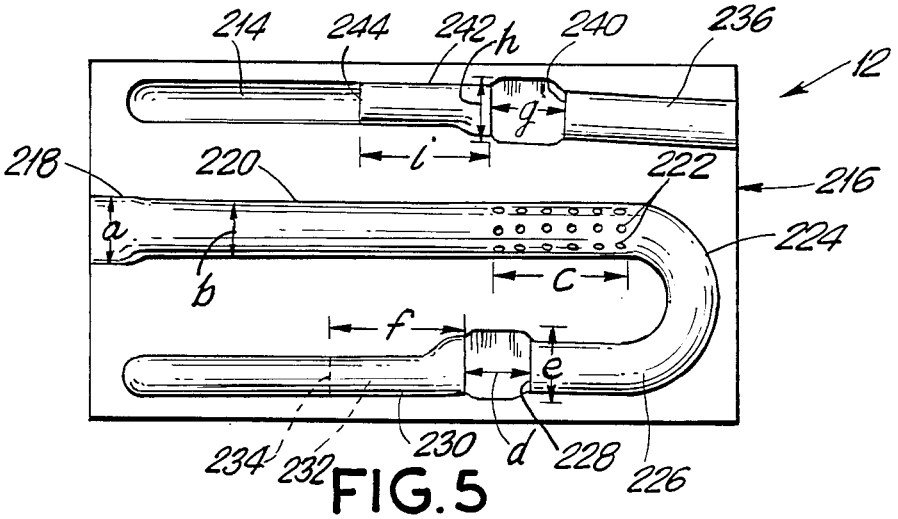
FIG. 5 is a cross sectional view taken along line 5—5 in FIG. 3.
Figure 6:
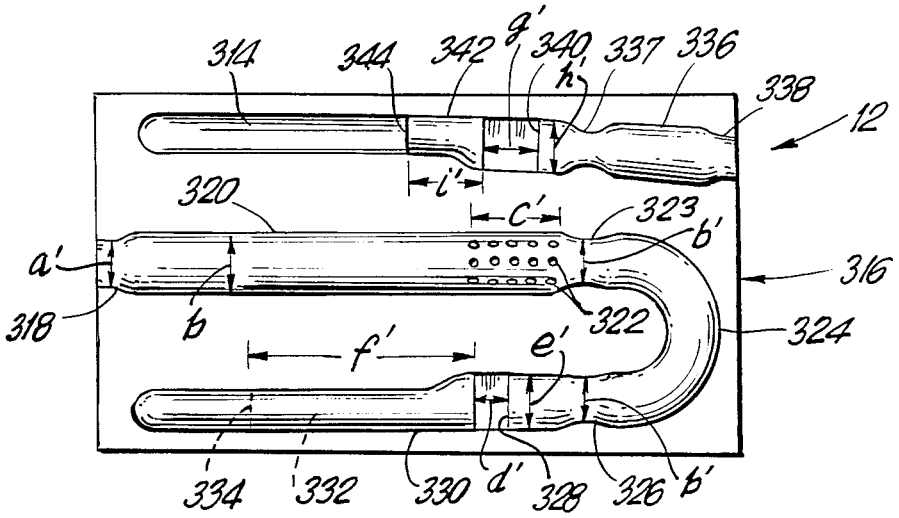
FIG. 6 a cross sectional view taken along line 6—6 in FIG. 3.

FIGS. 4–6 further illustrate the optional muffler configurations that can be made by the method of the subject invention. In particular, FIG. 4 is a die capability illustration which schematically shows typical locations on the internal plate 16 which may be varied by the selection of replaceable die subsets or replaceable die inserts. In particular, the internal plate 16 includes an inlet location 100 and an outlet location 102, each of which, in this illustrative example, may be provided with diameters of between 1.50 and 2.75 inches depending upon the particular subset or insert selected. With all such subsets or inserts, any reduction in diameter will be tapered to mate with the elongated inlet and outlet channels 104 and 106. Similarly, the internal plate 16 defines locations 108, 110 and 112 where a die subset or insert is capable of necking down the diameter and cross sectional area defined by the respective channels. The selection of subsets or inserts for locations 108–112 can be made independently of one another and can be operative in this example to achieve diameters of between 1.50 and 2.75 inch. Again, in each instance, the inserts that are capable of being placed in locations 108–112 are appropriately tapered to insure that a continuous smooth channel configuration is provided in the internal plate 16.

Locations 114 and 116 on the internal plate 16 define locations where die subsets or inserts are capable of providing cut outs or apertures of different lengths and widths. As will be explained further below, the cut outs at locations 114 and 116 are provided to achieve a cross flow of exhaust gases therebetween. The amount of flow of exhaust gases between the cut outs at locations 114 and 116 respectively will be determined in part by the length and width of the cut outs. Smaller cut outs at locations 114 and 116 may result in a greater back pressure and a greater proportion of the exhaust gases being urged through the perforations 84. Finally, the locations 118 and 120 enable the selection of subsets or inserts to alter the length and/or cross sectional area of tuning tubes. The length and cross sectional area of the tuning tubes can be altered in accordance with the particular low frequency sound to be attenuated thereby.

FIGS. 5 and 6 show hypothetical examples of mufflers 12 with two different assemblies of internal plates 214/216 and 314/316 which have been formed from common master dies having different selections of die subsets and inserts therein. The internal plate 216 is formed to include an inlet 218 having a diameter "a" which is slightly greater than the diameter "b" of the channel 220. The internal plate 216 further is formed to comprise a large array of perforations indicated generally by the numeral 222 and defining a length "c". It will be noted that the diameter of the inlet channel 220 remains substantially constant throughout the portion thereof defined by the array of perforations 222.

The internal plate 216 is further formed to define a curved portion 224 which continues at substantially the same diameter through a return channel 226 and terminates at a cut out 228 defining a length "d" and a width "e". A continuous tuning channel 230 extends in the internal plate 216 from the cut out 228. A corresponding tuning channel 232 having a length "f" is formed in the internal plate 214. The length "f" of the tuning channel 232 is defined by the length of the cut out 234 which is achieved by an appropriate die subset in the master die or die insert in a subset.

An outlet channel 236 of substantially constant diameter extends from a cut out 240. The cut out 240 defines a length "g" and a width "h" which are determined by the die subset placed in the master die or the insert placed in a subset. A tuning channel 242 having a length "i" extends from the cut out 240. In particular, the length "i" is defined by the dimensions of a tuning cut out 244 which in turn is determined by the particular subset placed in the master die or insert placed in a subset.

In operation, exhaust gases would enter the inlet channel 218 and flow toward the curved portion 224, with portions of the exhaust gases expanding through the perforations 222. A cross flow from cut out 228 to cut out 240 would be achieved through a chamber defined by an external shell of the muffler, such as the chamber 36 depicted in FIGS. 1 through 3. The exhaust gases would continue to flow through the outlet channel 236. However, the tuning channels 230/232 and 242 would perform attenuation of low frequency sounds. The particular low frequency sounds being attenuated would be determined by the respective lengths "f" and "i" and by the respective cross sectional dimensions.

The alternate internal plates 314 and 316 shown in FIG. 6 have substantially identical external dimensions as the internal plates 214 and 216 shown in FIG. 5. Additionally, the relative positions of the channels stamp formed therein are substantially identical. However, by virtue of using a different array of subsets and inserts to form the locations depicted in FIG. 4, the performance of a muffler employing internal plates 314 and 316 could be substantially different from a similarly configured muffler employing the internal plates 214 and 216. In particular, with reference to FIG. 6, the internal plate 316 is formed to define an inlet 318 having a necked down diameter "a'" which is less than the diameter "b" of the inlet channel 320. The inlet channel 320 extends to an array of perforations indicated generally by the numeral 322. It will be noted, however, that the array of formed perforations defines a length "c'" which is less than the length "c" of the perforation array 222 on the internal plate 216 described and illustrated above. Additionally, the inlet channel 320 terminates at a necked down portion 323 which is formed to define a diameter "b'" which is less than the diameter "b".

The curved channel portion 324 is formed to define a constant diameter which substantially equals the diameter of the curved channel 224 in FIG. 5. However, the curved channel 324 in FIG. 6 terminates at a necked down portion 326 defining a diameter "b'". It will be noted that the necked down portions 323 and 326 are achieved by the appropriate selection of subsets in the master die or inserts in a subset. The necked down portions 323 and 326 are depicted as being of substantially equal diameters, but other unequal relative dimensions are possible. The return channel extending from the necked down portion 326 terminates at a cut out 328 defining a length "d'" and a width "e'" both of which are less than the comparable dimensions of the cut out 228 on the internal plate 216.

A tuning tube extends from the cut out 328 and is defined by a tuning channel 330 in the internal plate 316 and by a tuning channel 332 in the internal plate 314. The tuning channel 332 defines a length "f'" which is greater than the length "f" of the tuning channel 232 depicted in FIG. 5. The length "f'" is determined by the cut out enabled by the particular die subset employed in the master die or insert employed in the subset.

The outlet channel 336 includes necked down portions 337 and 338. The cut out portion 340 leading into the outlet channel 336 defines a length "g'" and a width "h'" both of which are less than corresponding dimensions of the cut out portion 240 shown in FIG. 5. A tuning channel 342 defining a length "i" extends from the cut out portion 340.

It will be noted that the internal plates 314 and 316 are formed to be significantly different from the internal plates 214 and 216 at selected locations thereon. In particular, the internal plates 314 and 316 include necked down portions 318, 323, 326, 337 and 338 all of which are either indicative of a generally lower flow rate of exhaust gases or of a higher back pressure for any given flow rate of exhaust gases. Additionally, the array of perforations 332 formed in the internal plates 314 and 316 is larger than the corresponding array 222 depicted in FIG. 5. The tuning channels formed in the plates 314 and 316 are also of different dimensions than the corresponding tuning channels in the internal plates 214 and 216. As explained above, the different dimensions of these various portions of the array of channels are achieved by the selective use of die subsets in a master die or die inserts in one or more subsets. The selection of the inserts and subsets can significantly alter the performance of the muffler without altering the external configuration and without creating an entirely new set of master dies.

While the invention has been described with respect to a preferred embodiment, it is apparent that various changes can be made without departing from the scope of the invention as defined by the appended claims. For example, the master die may include fewer or more than the number of replaceable subsets and inserts illustratively and schematically depicted in the Figures above. The subsets and inserts may also be used in many different combinations than the two example provided above. Furthermore, the stamp formed muffler may comprise more or fewer components than the four illustrated herein.

We claim:

1. A process for forming a stamp formed muffler having a selected acoustical performance, said process comprising the steps of:

providing a master die having at least one mounting means for securely but releaseably receiving a plurality of die subsets;

providing a plurality of different die subsets, each of said die subsets being selectively and removably mountable to the mounting means of said master die, said die subsets being configured to form an array of channels in a sheet of metal;

selecting die subsets from said plurality of die subsets in accordance with a desired configuration for said array of channels;

securely but removably mounting said selected die subsets in the mounting means of said master die;

stamp forming at least one first sheet of metal with said master die and said die subsets to define an array of channels with the desired configuration in said sheet of metal;

disposing said formed sheet of metal in generally face to face relationship with a second sheet of metal, such that the formed channels and the second sheet of metal define an array of tubes therebetween;

providing at least one external shell having at least one formed chamber therein for surrounding at least a portion of said tube; and securely connecting said external shell to said formed sheet and said second sheet to define said muffler, whereby the acoustical performance is determined by the selection of the die subsets from said plurality of different die subsets.

2. A process as in claim 1 wherein at least one said die subset comprises insert means for mounting at least one die insert therein, said process further comprising the steps of providing a plurality of different die inserts, mounting at least one die insert in the insert means of the die subset, whereby the acoustical performance of the muffler is in part determined by the selection of said die inserts.

3. A process as in claim 2 further comprising the step of stamp forming said external shell to define at least one chamber therein.

4. A process as in claim 2 wherein said master die comprises a plurality of said mounting means for mounting a plurality of separate die subsets, providing a plurality of arrays of die subsets, with the die subsets in each said array being selectively and removably mountable in one of said mounting means of said master die; and selecting one said die subset from each said array for mounting in said master die, the die subsets being selected from said arrays in accordance with a preselected pattern of channels and tubes for said muffler.

5. A process as in claim 2 wherein a plurality of said inserts are operative to form an array of perforation means in said sheet for permitting flow of exhaust gases from the tubes.

6. A process as in claim 2 wherein a plurality of said die subsets are operative to stamp tuning channels of different respective dimensions in said sheet, said die subsets being selected in said process to define a tuning channel of predetermined dimensions.

7. A process as in claim 2 wherein a plurality of said die inserts are dimensioned and configured to define a neck portion of said channels, said neck portion defining a different cross sectional dimension than portions of said channel adjacent thereto, said insert dies being selected in said process in accordance with predetermined dimensions for said neck portions of said channel.

8. A process as in claim 2 wherein a plurality of said die inserts are operative to form a cut out in said sheet, each of said die inserts in said plurality being configured to define cut outs of different dimensions.

* * * * *